US009331372B2

(12) United States Patent
Fackelmeier et al.

(10) Patent No.: US 9,331,372 B2
(45) Date of Patent: May 3, 2016

(54) DIRECTIONAL COUPLER

(71) Applicants: Andreas Fackelmeier, Thalmässing (DE); Klaus Huber, Effeltrich (DE); Stefan Pott, Nürnberg (DE)

(72) Inventors: Andreas Fackelmeier, Thalmässing (DE); Klaus Huber, Effeltrich (DE); Stefan Pott, Nürnberg (DE)

(73) Assignee: Siemens Aktiengesellschaft, München (DE)

( * ) Notice: Subject to any disclaimer, the term of this patent is extended or adjusted under 35 U.S.C. 154(b) by 91 days.

(21) Appl. No.: 14/093,267

(22) Filed: Nov. 29, 2013

(65) Prior Publication Data

US 2014/0152396 A1 Jun. 5, 2014

(30) Foreign Application Priority Data

Nov. 29, 2012 (DE) ..... 10 2012 221 913

(51) Int. Cl.
*H01P 5/18* (2006.01)
*H01P 1/185* (2006.01)
*H01P 3/08* (2006.01)

(52) U.S. Cl.
CPC . *H01P 5/18* (2013.01); *H01P 1/185* (2013.01)

(58) Field of Classification Search
CPC ..... H01P 5/18; H01P 5/184; H01P 5/185
USPC ..... 333/109–112, 116
See application file for complete search history.

(56) References Cited

U.S. PATENT DOCUMENTS 3,560,887 A * 2/1971 Napoli ..... H01P 1/2135 333/110
4,061,990 A * 12/1977 Ueno ..... H03D 9/0633 330/4.9
4,264,881 A * 4/1981 De Ronde ..... H01P 7/082 331/107 SL
4,287,605 A * 9/1981 Dydyk ..... H01P 1/2138 330/4.9
4,442,404 A * 4/1984 Bergmann ..... 324/309
4,706,049 A * 11/1987 Dydyk ..... H01P 5/185 333/110
5,424,694 A * 6/1995 Maloratsky et al. ..... 333/112
5,767,753 A * 6/1998 Ruelke ..... 333/116
6,225,879 B1 * 5/2001 Schallner ..... H01P 7/082 333/205
7,253,701 B2 * 8/2007 Smith et al. ..... 333/100
7,760,047 B2 * 7/2010 El Rai et al. ..... 333/116

FOREIGN PATENT DOCUMENTS

EP 1 052 523 A1 11/2000
KR 100893319 B1 4/2009

OTHER PUBLICATIONS

Korean Office Action dated Sep. 29, 2014 for corresponding Korean Patent Application No. 10-2013-145423 with English translation.
Zayed S.A. et al., "A Microstrip Directional Coupler with Tight Coupling and Relatively Wideband using Defected Ground Structure," ACES Journal, vol. 25, No. 11, pp. 877-887, 2010.

(Continued)

*Primary Examiner* — Dean Takaoka
(74) *Attorney, Agent, or Firm* — Lempia Summerfield Katz LLC

(57) ABSTRACT

A directional coupler includes a first conductive track, a second conductive track, and a conductive structure. The conductive structure includes a first partial region that is arranged nearer to the first conductive track than the first conductive track is to the second conductive track. The conductive structure also includes a second partial region that is arranged nearer to the second conductive track than the first conductive track is to the second conductive track.

25 Claims, 6 Drawing Sheets

(56) References Cited

OTHER PUBLICATIONS

Geuzebroek H.D. et al., "8 Ring-Resonator-Based Wavelength Filters," Springer Berlin Heidelberg, pp. 342-379, ISBN 9783540317692, 2006.

German Search Report dated Apr. 16, 2013 for corresponding German Patent Application No. DE 102012221913.7 with English translation.

S. Sarkar, et al., "Analysis and Application of 3-D LTCC Directional Filter Design for Multiband Millimeter-Wave Integrated Module," IEEE Transactions on Advanced Packaging, vol. 30, No. 1, pp. 124-131, Feb. 2007.

S. B. Cohn, et al., "Directional Channel-Separation Filters," Proceedings of the IRE National Convention, vol. 44, No. 8, pp. 1018-1024, 1956.

* cited by examiner

DIRECTIONAL COUPLER

This application claims the benefit of DE 10 2012 221 913.7, filed on Nov. 29, 2013, which is hereby incorporated by reference in its entirety.

BACKGROUND

The present embodiments relate to a directional coupler.

The directional coupler is a component appertaining to radio-frequency technology. Planar directional couplers, for example, are used. The requirements made of the coupling attenuation, the directivity factor and other parameters may be fulfilled only by an individual design. The directional couplers may be used for measurement purposes or for other purposes (e.g., in a magnetic resonance tomograph used to generate images of the human or animal body using nuclear spin effects in a high magnetic field). The terms conductive track and conductor track are used synonymously hereinafter.

SUMMARY AND DESCRIPTION

The scope of the present invention is defined solely by the appended claims and is not affected to any degree by the statements within this summary.

The present embodiments may obviate one or more of the drawbacks or limitations in the related art. For example, a directional coupler that is constructed in a simple manner and has, for example, a high coupling attenuation and a high directivity factor is provided. For example, the directional coupler is intended to be suitable for a planar construction.

The directional coupler may include a first conductive track or conductor track, a second conductive track or conductor track, and a conductive structure. The conductive structure includes a first partial region that is arranged nearer to the first conductive track than the first conductive track is to the second conductive track. The conductive structure includes a second partial region that is arranged nearer to the second conductive track than the first conductive track is to the second conductive track.

A directional coupler is a component having four ports or terminal pairs. A power fed to one port is split into two partial powers and fed to loads or sensing devices at two other ports, while no power or only a very low power occurs at the fourth port.

There may be a continuous line between a first port and a second port. There may also be a continuous line between a third port and a fourth port. The two continuous lines are insulated from one another (e.g., by a solid dielectric material). A forward running wave on one line appears as a backward running wave on the other line.

The quotient of the fed-in power in the numerator (top) (e.g., at the first port) and the power in the coupled line in the denominator (bottom), (e.g., at the third port) is designated as the coupling attenuation.

The quotient of the power at the third port in the numerator and the power at the fourth port in the denominator is designated as the directivity factor. The directivity factor is a measure of the quality of the directional coupler.

The first conductive track may be arranged in a first conductive track layer. The first conductive track is also designated as a power line.

The second conductive track or conductor track may be arranged in the first conductive track layer, in a second conductive track layer or in a third conductive track layer. The second conductive track is also designated as a coupling line or as a sense line or, when the sensed values are converted to System International (SI) variables, as a measuring line.

The conductive structure may be arranged in the first conductive track layer, in the second conductive track layer or in the third conductive track layer. The conductive structure may be embodied as a coupling loop or coupling frame (e.g., having rounded or angular direction changes). Alternatively, a coupling surface may also be used (e.g., a rectangle or a rectangle having rounded corners). The coupling surface may have the same technical effect as the coupling loop or the coupling frame (e.g., on account of the skin effect or some other effect).

The directional coupler may detect, for example, the power that is reflected back from an antenna terminal or coil terminal to which power is transmitted by an amplifier. A defective terminal, for example, may thus be detected. The amplifier may be switched off before the reflected power destroys the amplifier. Such or similar applications of a directional coupler may occur, for example, in magnetic resonance tomography or nuclear spin tomography, in plasma generation technology and/or energy technology or in other fields.

The conductive structure may be arranged between the first conductive track and the second conductive track. Examples are explained in greater detail below. Only one conductive track layer may be used, or conductive track layers arranged parallel to one another may be used (e.g., conductive track planes). In the case of a plane, a planar directional coupler arises. As an alternative to planes, conductive track layers that lie on cylindrical surfaces or on differently shaped surfaces may also be used.

The conductive track layers may be arranged at a distance from one another. The distance arises, for example, as a result of the layer thickness of an intermediate dielectric or interlayer dielectric. The distances between the mutually different conductive track layers may be the same or different from one another. The dielectric between the conductive tracks and the conductive structure may be a solid material.

The distances indicated may relate, for example, to the conditions in the directional coupler. In other words, other distances or arrangements may exist outside the directional coupler.

What is achieved by the additional inclusion of the conductive structure in the directional coupler is that the coupling attenuation becomes very high on account of the double coupling. However, the directivity factor is also sufficiently high, and/or deviations from specified parameters (e.g., coupling attenuation and directivity factor) that are caused by manufacturing tolerances may be reduced. Additional parameters arise for the setting of the electrical properties of the directional coupler. In this regard, the size of the conductive structure (e.g., width and length) may be optimized.

The length of the conductive structure may increase with increasing distance between the first conductive track and the second conductive track. The distance between the conductive structure and the first conductive track and/or the second conductive track may be optimized independently of one another at two coupling locations. This affords more degrees of freedom than an optimization of only one coupling location.

The first conductive track may be electrically insulated from the conductive structure. The second conductive track may also be electrically insulated from the conductive structure.

The conductive tracks and the conductive structures may be arranged in configurations on a substrate (e.g., composed of a printed circuit board material based on Teflon or glassfiber-reinforced plastic such as epoxy resin, FR-4, Rogers, or composed of a ceramic material such as a thin film network (TFN)).

A substrate having only one conductively coated and/or structured side may be used. Alternatively, a substrate having two conductively coated and/or structured sides facing away from one another may be used. A substrate having more than two conductive track layers may also be used.

In one configuration, the first conductive track and/or the second conductive track may extend in each case in a straight direction. The two conductive tracks may be arranged parallel to one another (e.g., at an angle of approximately zero angular degrees, or at an angle that may be in the range of 1 angular degree to 45 angular degrees).

In addition to the use of the conductive structure in the directional coupler, a calibration of the directional coupler may also be carried out. The calibration may be carried out in an automated manner, for example.

The first conductive track, the second conductive track and the conductive structure may be arranged in a single conductive track layer. The distances between the first conductive track and the first partial region and between the second conductive track and the second partial region may thus be used as design parameters. An overlap is not possible, or overlaps are not possible with the use of only a single conductive track layer. However, the directional coupler is constructed in a very simple manner, and it is not necessary to align conductive tracks and/or conductive structures in mutually different conductive track layers with respect to one another.

The first conductive track, the second conductive track and the conductive structure may also be arranged in two conductive track layers. The use of two conductive track layers allows the first conductive track and the conductive structure and/or the second conductive track and the conductive structure to be arranged with an overlap. The overlap may enable larger manufacturing tolerances (e.g., with regard to a misalignment with regard to an arrangement angle). A substrate provided with conductor tracks and/or the conductive structure on both sides may be used. A conductive track layer may also be arranged within the substrate. Alternatively, both conductive track layers may be arranged within the substrate. Surprisingly, both production tolerances of the conductive tracks and/or conductive structure and tolerances in the alignment of conductive tracks and/or conductive structures in mutually different conductive track layers may be compensated for well by the overlap or the overlaps.

In one embodiment, the first conductive track layer is adjacent to the second conductive track layer. Alternatively, there may be one or a plurality of further conductive track layers between the first conductive track layer and the second conductive track layer.

The conductive structure may be arranged in a different conductive track layer than the first conductive track and than the second conductive track. Although only two conductive track layers are used, a double overlap may be provided (e.g., as seen in a direction that is counter to the direction or in the direction of a normal to a planar substrate surface or to a planar conductive track layer such as a substrate surface on which the first conductive track and/or the second conductive track are/is arranged or a conductive track layer in which the first conductive track and/or the second conductive track and/or the conductive structure are/is arranged). Furthermore, symmetrical directional couplers can thus be constructed.

Both conductive tracks lie in one conductive track layer that may facilitate the connection. Furthermore, the use of two conductive track layers may allow further degrees of freedom in the design. A design with symmetrical overlap may also be provided.

The first conductive track may be arranged in a different conductive track layer than the second conductive track and the conductive structure. In this variant, only a single overlap may be provided. Consequently, asymmetry may also be present. However, there may be applications in which the arrangement of conductive structure and the second conductive track in one conductive track layer is provided.

The first conductive track, the second conductive track and the conductive structure may also be arranged in three conductive track layers. The use of three conductive track layers again allows the first conductive track and the conductive structure and/or the second conductive track and the conductive structure to be arranged with an overlap. The overlap may enable larger manufacturing tolerances (e.g., with regard to a misalignment such as with regard to an arrangement angle). With the use of three conductive track layers, tolerances in the alignment of the different conductive track layers with respect to one another and other production tolerances may be compensated for well.

A substrate provided with conductor tracks and/or the conductive structure on both sides may be used. A conductive track layer may also be arranged within the substrate. Alternatively, two of the three conductive track layers or all three conductive track layers may be arranged within the substrate. The use of three conductive track layers allows further degrees of freedom in the design. For example, symmetrical arrangements and asymmetrical arrangements may be realized.

In one configuration, a third conductive track layer lies between a first conductive track layer and a second conductive track layer. In one embodiment, the third conductive track layer is adjacent to the first conductive track layer and the second conductive track layer. Alternatively, there may be one or a plurality of further conductive track layers between the first conductive track layer and the second conductive track layer and/or between the second conductive track layer and the third conductive track layer.

In one configuration, an arrangement may include the first conductive track in the first conductive track layer, the conductive structure in the second conductive track layer, and the second conductive track in the third conductive track layer.

This enables a symmetrical arrangement of the conductive tracks with respect to the conductive structure.

Alternatively, in another configuration, the arrangement includes the first conductive track in the first conductive track layer, the second conductive track in the second conductive track layer, and the conductive structure in the third conductive track layer.

In this configuration, for example, the second conductive track ply or layer may be used for increasing the distance between the first conductive track and the second conductive structure or the coupling structure without the lateral substrate surface being required for this distance.

The conductive structure may overlap the first conductive track in the first partial region and/or optionally overlap the second conductive track in the second partial region. In this case, the overlap may occur as seen counter to or in a normal direction. The normal relates to a substrate surface or conductive track plane in which the first conductive track, the conductive structure and/or the second conductive track are/is arranged.

The overlap may make it possible for the coupling attenuation, increased greatly by the two coupling locations, to be reduced again somewhat or for the directivity factor to be increased. Two overlap locations afford more degrees of freedom in the design than one overlap location or than no overlap. Manufacturing tolerances may also be compensated for well by the overlap(s). In other words, electrical parameters of the directional coupler become more independent of manufacturing tolerances.

The first conductive track at least in the region of the directional coupler may be straight and have a first width. The conductive structure in the first partial region may be straight and have a second width. The first partial region may be arranged substantially parallel to the first conductive track (e.g., within the scope of the manufacturing tolerances). For a first distance between the center line of the first partial region and the center line of the first conductive track, the first distance may be at least the difference between half of the first width and half of the second width, and the first distance may be at most 80 percent or at most 90 percent of the sum of half of the first width and half of the second width.

The largest overlap occurs at the lower range limit in the case of overlap of the outer edges of first partial section and first conductive track. The smallest overlap occurs at the upper range limit in the case of a comparatively small overlap of first partial section and first conductive track. A range that enables particularly good directional coupler properties is thus specified for the overlap. This range enables a coupling attenuation that is not excessively high in conjunction with a directivity factor that is not excessively low. Production tolerances when aligning the first conductive track and the first partial section and other production tolerances may be compensated for well.

In configurations, the specified range limits are shifted with regard to the lower limit in a range of minus 30 percent of the lower limit to plus 30 percent of the lower limit and/or with regard to the upper limit in a range of minus 30 percent of the upper limit to plus 30 percent of the upper limit.

The second conductive track, at least in the region of the directional coupler may be straight and have a third width. The conductive structure in the second partial region may be straight and have a fourth width. The second partial region may be arranged substantially parallel to the second conductive track (e.g., within the scope of the manufacturing tolerances). For a second distance between the center line of the second partial region and the center line of the second conductive track, the second distance may be at least the difference between half of the third width and half of the fourth width, and the second distance may be at most 80 percent or at most 90 percent of the sum of half of the first width and half of the fourth width.

Therefore, the statements and technical effects indicated above for the first distance correspondingly hold true for the second distance. The limits of the second distance may also be correspondingly shifted in the range of minus 30 percent to plus 30 percent as indicated above for the first distance.

The first width may be greater than the second width. The first width may be greater than the second width (e.g., by at least 50 percent or by at least 100 percent; at least double the magnitude). Alternatively, however, both widths may also be identical.

The conductive structure may have a circumferential edge or a center line having a length that is less than 20 percent or less than 10 percent of the wavelength of electromagnetic waves for the transmission of which the first conductive track is designed. In the case of a filter arrangement, the length of the circumferential edge or of a center line of a coupling loop or of a coupling frame may correspond approximately to the design wavelength. The filter arrangement may then filter out a wave of the design wavelength from the power line and output the wave on the coupling line/measuring line. In contrast thereto, the opposite is implemented in one embodiment in order to couple out the smallest possible power of waves with the design wavelength.

Precisely the combination of this length of the circumferential edge or of the center line and the at least two coupling locations and optionally the overlap in the ranges mentioned above makes it possible to achieve design goals not achievable with directional couplers used heretofore. The length of the circumferential edge may be coordinated in interaction with the size of the overlap.

As mentioned above, the conductive structure may be embodied as a coupling loop or as a coupling frame (e.g., having rounded or angular direction changes). Alternatively, a coupling surface (e.g., a rectangle or a rectangle having rounded corners) may also be used. The coupling surface may have the same technical effect as the coupling loop or the coupling frame (e.g. on account of the skin effect or some other effect).

The directional coupler may be coupled by an input to a unit that outputs electromagnetic waves having the design wavelength. The unit may be an amplifier (e.g., a high-power amplifier having a power of greater than 1 kilowatt or greater than 10 kilowatts, such as are used in magnetic resonance tomography apparatuses). For example, pulsed powers that occur, for example, for a time of less than 1 second or less than 500 milliseconds but greater than 1 nanosecond may be involved. In this case, the design wavelength may relate to the waves having the greatest energy proportion (e.g., maximum) or having the essential energy proportion (e.g., to at least 50 percent of the energy to be transmitted).

The conductive structure may be a first conductive structure. The directional coupler may include a second conductive structure including a first partial region that is arranged nearer to the first conductive structure than a second partial region of the second conductive structure. The second partial region may be arranged nearer to the second conductive track than to the first conductive structure.

The second conductive structure may be electrically insulated from the first conductive track, the second conductive track and from the first conductive structure. The second conductive structure may be embodied as a coupling loop or as a coupling frame (e.g., having rounded or angular directional changes). Alternatively, a coupling surface (e.g., a rectangle or a rectangle having rounded corners) may also be used. The coupling surface may have the same technical effect as the coupling loop or the coupling frame (e.g., on account of the skin effect or some other effect). Both conductive structures may be embodied in the same way (e.g., as coupling loop, coupling frame or coupling surface). Alternatively, both conductive or coupling structures may be embodied differently from one another.

The use of the second conductive structure results in three coupling locations, which increases the coupling attenuation and/or opens up further degrees of freedom for the design. In other embodiments, more than two conductive structures and/or coupling loops or coupling surfaces may be used.

The second conductive structure may overlap the first conductive structure in the first partial region and/or the second conductive track in the second partial region. The overlap may occur as seen in or counter to a normal direction. The normal relates to a substrate surface or conductive track plane in which the first conductive track, the first conductive structure, the second conductive structure and/or the second conductive track are/is arranged.

The overlap may make it possible for the coupling attenuation to be increased or for the directivity factor to be increased. Two or three overlap locations afford more degrees of freedom in the design than two overlap locations, than one overlap location or than no overlap. Alternatively, there may be no overlaps with regard to the second conductive structure.

The conductive structure or the first conductive structure and/or the second conductive structure may be embodied as a coupling loop or as a coupling frame that encloses a non-conductive zone. The enclosure may, for example, be complete. In one configuration, the coupling frame may have an outer and/or inner edge lying in each case along the contour of a rectangle, such that a rectangular frame is formed. Alternatively, the corners of the rectangle or frame may be rounded, or the first and/or second conductive structure may have a different shape, (e.g., circular, elliptic) if appropriate with flattened sections in the vicinity of the coupling locations.

In one configuration, the non-conductive zone may again enclose a conductive zone (e.g., completely). The conductive zone may be provided for shielding purposes. Thus, the non-conductive zone may be very narrow and elongated and produce a self-contained enclosing course.

Alternatively, in one configuration, a conductive surface or coupling surface (e.g., a rectangle or a rectangle having rounded corners) may be used. The coupling surface may completely cover a zone enclosed by a corresponding edge with conductive material (e.g., with copper). The coupling surface may have the same technical effect as the coupling loop or the coupling frame on account of the skin effect or some other effect.

The length of the first conductive track may be less than 5 percent or less than 1 percent of one quarter of a design wavelength. This measure also reduces the coupling attenuation. At 100 MHz, the wavelength or lambda is, for example, 3 meters. One quarter of the wavelength is, for example, 75 centimeters. The line length would thus be 7.5 millimeters in the case of one percent of quarter lambda. At 1 GHz, the wavelength or lambda is, for example, 30 centimeters. One quarter of the wavelength is 7.5 centimeters. The line length would thus be 0.75 millimeters in the case of one percent of quarter lambda.

The largest lateral extent of the first conductive structure and/or of the second conductive structure may be, for example, less than 150 percent of the stated length indications.

The directional coupler may be used in a magnetic resonance tomograph or in a nuclear spin tomograph (e.g., for determining a transmission power transmitted back from a coil via a transmission line).

Typical pulse transmission powers in a magnetic resonance tomograph or a nuclear spin tomograph are greater than 10 kilowatts per coil, such that particular requirements that may be fulfilled only through the use of the intermediate conductive structure may be imposed on the directional coupler. However, there may also be other applications (e.g., plasma technology and/or energy technology).

In one configuration, a plurality of directional couplers are arranged on a substrate (e.g., at a distance that is less than 5 centimeters). In this regard, the directional couplers may, for example, be arranged for more than three or more than five transmission channels on a circuit board or on a substrate (e.g., in a magnetic resonance tomograph). This close arrangement may be provided because each of the directional couplers couples out only a low power on account of the conductive structure, without there being heat losses to be dissipated by large-area elements that are disadvantageous. The number of directional couplers on the substrate may be less than 50 or less than 100.

In another configuration, there are a number of sensing or measuring devices corresponding to the number of directional couplers, such that the directional couplers may be in operation simultaneously in order, for example, to monitor a plurality of transmission channels simultaneously. The sensing or measuring devices may be calibrated automatically, for example.

In one configuration, the directional coupler or all directional couplers addressed has/have at least one of the following parameters: a directivity factor greater than 20 dB or greater than 25 dB; and/or a coupling attenuation greater than 50 dB or greater than 60 dB.

In a next configuration of the abovementioned directional couplers, the power that may be transmitted via the power line or the first conductive track is greater than 1 kW (kilowatt), 10 kW, 25 kW, 100 kW or 1000 kW. The power that may be transmitted may be, for example, less than 10 000 kW. The stated powers may be pulse powers. Alternatively, reference may also be made to average lines (e.g., the powers that may be transmitted are then in the range of 10 watts to 5 kilowatts). The power or a reflected power may be detected at low power, which may be attributed to the use of the conductive structure and the associated increase in the number of coupling locations, and, for example, to the abovementioned dimensions of the elements of the directional coupler.

In another configuration, the largest dimension of the directional coupler is smaller than 5 centimeters or even smaller than 2 centimeters. These dimensions also hold true for the abovementioned transmission powers of the directional coupler.

The design frequency may be in the range of 50 MHz to 200 MHz (e.g., at 123.2 MHz in the case of an application of the directional coupler in a magnetic resonance tomograph or in a nuclear spin tomograph). Future ranges are 300 MHz to 600 MHz. In other applications or else in other magnetic resonance tomographs or in a nuclear spin tomograph, the range may be from, for example, 1 MHz to more than 10 GHz, more than 100 GHz or higher.

In a further configuration, a shielding lies above the second conductive track and the conductive structure but not above the first conductive track. Energy may thus be coupled from the first conductive track into the conductive structure. Disturbances proceeding from the first conductive track do not directly reach the second conductive track, however, on account of the shielding. Alternatively or additionally, the first coupling location may also be shielded toward the outside (e.g., with an enclosure composed of a metal).

In a next configuration, the directional coupler may have at least one terminal to which a line may be fixed with the aid of a screw connection or clamping connection (e.g., BNC connection and/or QLA connection or SMA connection). A simple installation and a simple demounting of the directional coupler may thus be provided (e.g., for maintenance purposes).

In another configuration, the entire directional coupler is shielded toward the outside in order to avoid or reduce coupled-in interference.

In other words, a directional coupler having high coupling attenuation that may be used, for example, in magnetic resonance tomography or in plasma technology is specified. In magnetic resonance tomography, the directional coupler may be used, for example, for future ultra high frequencies (UHF) (e.g., 300 MHz (megahertz) to 1 GHz (gigahertz)) systems (e.g., for transmitting units).

In magnetic resonance tomography, for example, in future equipment generations, powers above 30 kW may occur in the transmission path and are to be measured very accurately in terms of amplitude and phase. For this purpose, use will be made of planar directional couplers, for example, with which a small portion of the signal power is coupled out and fed to the measuring device. The directional coupler may include a line that over a specific length (e.g., much smaller such as less than 10 percent than the wavelength) is led parallel to the signal line to be measured. The distance between these two lines determines the coupling attenuation in this case. At the high powers occurring, the directional coupler line is to be positioned at a relatively large distance from the signal line in order to be able to obtain a coupling attenuation in the range of, for example, above 50 dB. In combination with a required directivity factor of, for example, more than 25 dB, this may not be realized even with manual individual adjustment (e.g., undesired here) for a series product since, as a result of the large distances, relatively small manufacturing tolerances and parameter fluctuations adversely affect the properties of the directional coupler.

Hitherto, for example, directional couplers having a coupling attenuation of approximately 30 dB have been used, and the required further attenuation has been obtained by attenuation elements. This has the disadvantage, however, that high-power attenuation elements are to be used, and a high heat loss that is to be dissipated arises. This is not practicable in the case of high powers and multi-channel systems.

With the aid of an additional coupling loop, for example (see FIG. 1), for example, the signal overcoupling is divided between two line regions connected in series. This reduces the required coupling attenuation per coupling location to half. For the planar directional coupler in accordance with FIG. 3, this results in the advantage that the coupling lines, which may be situated, for example, on different printed circuit board sides, may be at a smaller distance from one another or may even distinctly overlap. Parameter fluctuations thus have considerably less influence. A plurality of loops may also be used in order to obtain even higher coupling attenuations or/and to further reduce the influence of parameter fluctuations.

In a further embodiment in planar form, a rectangle is used instead of the loop. This has the advantage that fewer radio frequency (RF) interference signals are coupled in or out. The RF interference signals may also be suppressed by ground surfaces in the loop.

By virtue of the signal coupling-out according to FIGS. 1 to 3, no adjustment may be required for obtaining a high directivity factor, since a coupling attenuation in the range of 25 dB is readily reproducible in terms of manufacturing technology. A calibration may nevertheless be carried out. No cost- and time-intensive manual adjustment may be required. The double overcoupling makes it possible to obtain significantly higher total coupling attenuations than with a conventional directional coupler. In contrast to a conventional directional coupler, no power attenuation elements may be required, and complex measures for heat dissipation may no longer be required.

The directional coupler may be embodied in planar fashion or using stripline technology. However, the directional coupler may also be embodied with the aid of waveguides.

In so far as the term "may" is used in this application, it concerns both the technical possibility and the actual technical implementation. In so far as the term "approximately" is used in this application, this provides that the exact value is also disclosed.

DETAILED DESCRIPTION

Figure 1:
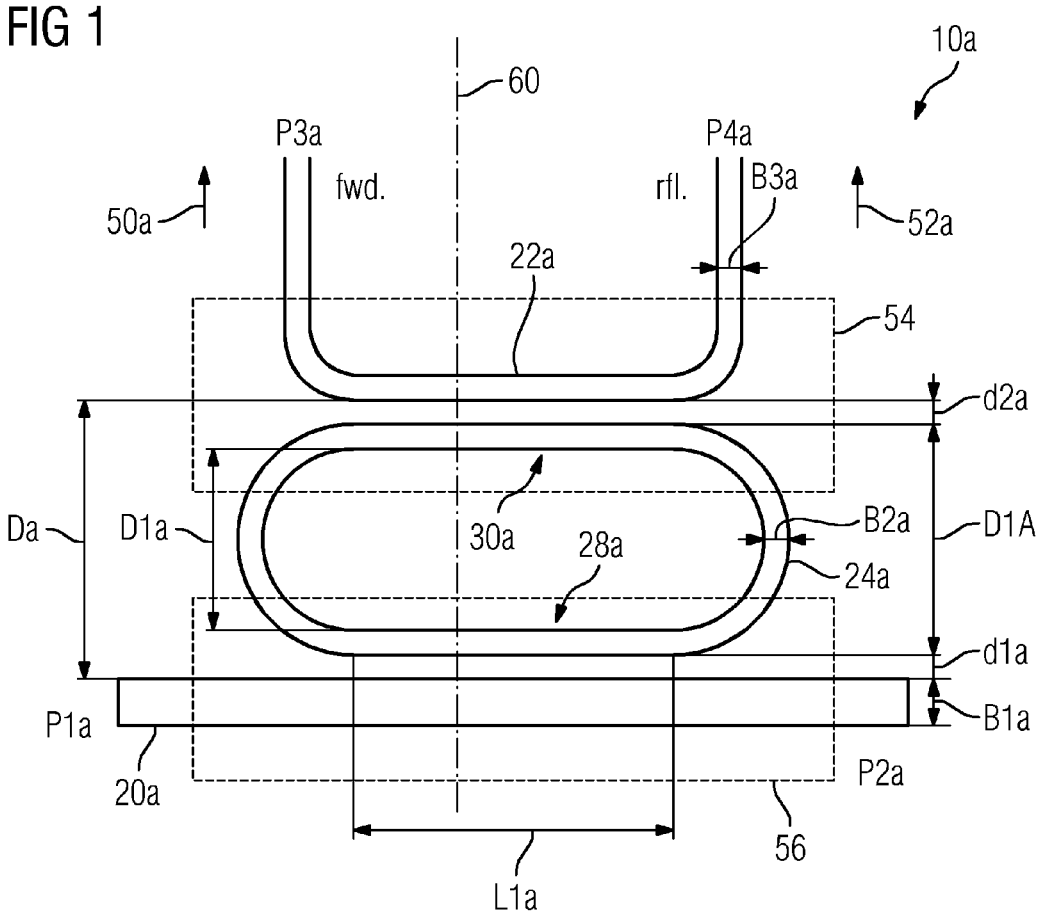
FIG. 1 shows one embodiment of a directional coupler having one coupling loop and without overlap.

FIG. 1 shows one embodiment of a directional coupler 10*a* including one coupling loop 24*a*. The directional coupler 10*a* includes a power line 20*a* and a coupling line 22*a* arranged parallel to the power line 20*a*. The coupling line is also designated as sense line or measuring line. The directional coupler 10*a* also includes a coupling loop 24*a* that is arranged between the power line 20*a* and the coupling line 22*a*.

In the example in FIG. 1, the power line 20*a* is straight and has edges lying parallel to one another. The coupling line 22*a* has a straight coupling section having edges lying parallel to one another. After the coupling section, the coupling line 22*a* at both ends is angled away from the coupling loop 24*a* (e.g., with round sections). Alternatively, the coupling line 22*a* may also be straight in accordance with the course of the power line 20*a* (e.g., also see FIG. 3).

In the example, the coupling line 22*a* having a width B3a is narrower than the power line 20*a* having a width B1a (e.g., by more than 50 percent relative to the width B1a). However, the coupling line 22*a* and the power line 20*a* may also be of the same width. The coupling line 22*a* may also be wider than the power line 20*a*.

In the example, the coupling loop 24*a* has the same width B2a as the width B3a of the coupling line 22*a*. However, the coupling line 22*a* my also be wider or narrower than the coupling loop 24*a*.

The power line 20*a*, the coupling line 22*a* and the coupling loop 24*a* are, for example, composed of an electrically conductive material (e.g., copper) and are arranged on a substrate (e.g., see FIGS. 5 to 8). The substrate is, for example, a printed circuit board material, a ceramic substrate or a specific radio-frequency substrate.

The height of the power line 20*a*, of the coupling line 22*a* and of the coupling loop 24*a* is determined according to the known design criteria for striplines. The height may, for example, be the same for all three elements 20*a*, 22*a* and 24*a*.

The coupling loop 24*a* is embodied in a ring-shaped fashion and has, at two sides situated opposite one another, a straight partial region 28*a* having edges parallel to one another and a straight partial region 30*a* having edges parallel to one another. The partial region 28*a* lies parallel to and in the vicinity of the power line 20*a*. The partial region 30*a* lies parallel to and in the vicinity of the coupling line 22*a*.

The partial region 28*a* and the partial region 30*a* are electrically conductively connected to one another at respective left ends by, for example, a circle-arc-shaped or arcuate section of the coupling loop 24*a*. The partial region 28*a* and the partial region 30*a* are electrically conductively connected to one another at respective right ends by, for example, a further circle-arc-shaped or arcuate section of the coupling loop 24*a*.

The directional coupler 10*a* includes a port P1a or terminal (e.g., used as input), a port P2a (e.g., used as output), a port P3a (e.g., used for coupling out the forward (fwd.) transmitted waves; see arrow 50*a*), and a port P4a (e.g., used for coupling out the reflected (rfl.) waves (i.e., the backward transmitted waves or power); see arrow 52*a*).

Given suitable termination with, for example, a termination resistor, the port P3a and/or the port P4a may also remain in a state of not being connected. When the directional coupler 10*a* is used, the reflected power may be tapped off at the port P4a and thus detected or measured. This is utilized in a magnetic resonance tomograph, for example, where the power line 20*a* is coupled on the input side to an amplifier and on the output side to a coil for generating a magnetic field.

The ports P1a to P4a may also be designated as terminals and may be operated relative to a ground line (not illustrated).

The directional coupler 10*a* is configured in accordance with Maxwell's equations applicable to the transmission of electromagnetic waves, and so the exact dimensions are dependent on a design wavelength. The dimensions illustrated in FIGS. 1 to 8 are not true to scale, but rather serve for simple illustration.

The directional coupler 10*a* includes, for example, the following geometrical design variables: a distance Da between mutually facing edges of the power line 20*a* and of the coupling line 22*a*; a distance D1a between mutually facing edges of the partial regions 28*a* and 30*a*; a distance D1A between edges of the partial regions 28*a* and 30*a* facing away from one another; a distance d1a between the edge of the power line 20*a* that faces the coupling loop 24*a* or the partial region 28*a* and the edge of the partial region 28*a* that faces the power line 20*a*; a distance d2a between the edge of the partial region 30*a* that faces the coupling line 22*a* and the edge of the coupling line 22*a* that faces the coupling loop 24*a* or the partial region 30*a*; a width B1a of the power line 20*a*; a width B2a of the coupling loop 24*a*; a width B3a of the coupling line 22*a*; and a length L1a of the power line 20*a* in the coupling region that ends, for example, when the curvature of the coupling loop 24*a* begins.

Other or additional design variables may also be, for example, defined distances relative to center lines. Values for the design variables mentioned are, for example, defined with the aid of the criteria mentioned in the introduction (e.g., on the basis of a high value for the coupling attenuation and a high value for the directivity factor). A simulation program for the simulation of radio-frequency circuits may also be used during the design.

In this regard, the length L1a in the example is considerably less than one quarter of the design wavelength and is, for example, less than 5 percent or less than 1 percent of one quarter of the design wavelength. The length L1a also corresponds to the length of the partial region 28*a*, to the length of the partial region 30*a* and to the length of the coupling section of the coupling line 22*a*.

The length of the coupling loop 24*a* is, for example, less than 5 percent or less than 1 percent of the design wavelength (e.g., measured at the outer circumferential edge or at a center line of the coupling loop 24*a*). The distance D1A is, for example, less than the length L1a (e.g., less than 80 percent of the length L1a). In an alternative exemplary embodiment, the distance D1A may also be equal to or greater than the length L1a.

The width B1a is, for example, less than 20 percent or less than 10 percent of the length L1a. The distances d1a and d2a are, for example, less than 20 percent or less than 10 percent of the width B1a.

The distance Da results, for example, from the sum of the distances d1a, D1A and d2a.

A shielding surface 54 indicated in FIG. 1 may be arranged above the coupling line 22*a* and above the partial region 30*a*. Additionally or alternatively, a shield 56 may be used above the power line 20*a* and the partial region 28*a*. The shield 56 may be arranged at a greater distance above the power line 20*a* than the shield 54 above the coupling line 22*a*.

The coupling loop 24*a* may be arranged, as illustrated in FIG. 1, without overlap with respect to the power line 20*a* and/or with respect to the coupling line 22*a*. Alternatively, at least one overlap is used, or two overlaps are used, corresponding, for example, e.g. to the overlaps illustrated in FIGS. 6 to 8.

Both shields 54 and 56 are optional and can be replaced or supplemented by shields in other conductive track planes.

Instead of the coupling loop 24*a*, a conductor surface filled in over the whole area and having the same contour may be used. The conductor surface has the same technical effect as the coupling loop 24*a* with regard to the coupling on account of the skin effect or other effects. In addition, a shielding effect such as is achieved by the shield 150 occurs (see FIG. 3).

Figure 3:
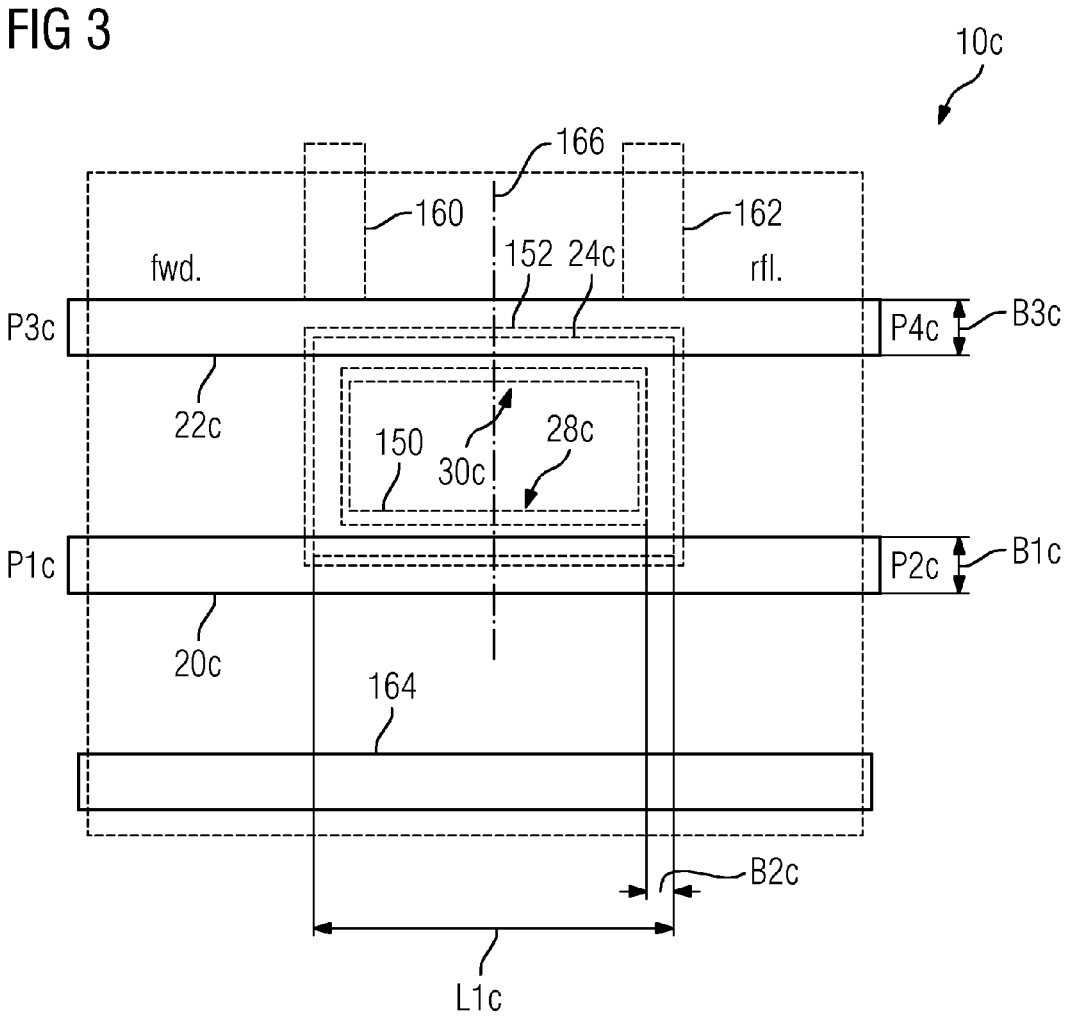
FIG. 3 shows one embodiment of a directional coupler having one coupling frame and overlaps.

A coupling frame may also be used instead of the coupling loop 24*a* (see FIG. 3).

A sectional line 60 is relevant to the cross sections illustrated in FIGS. 5 to 8.

Figure 2:
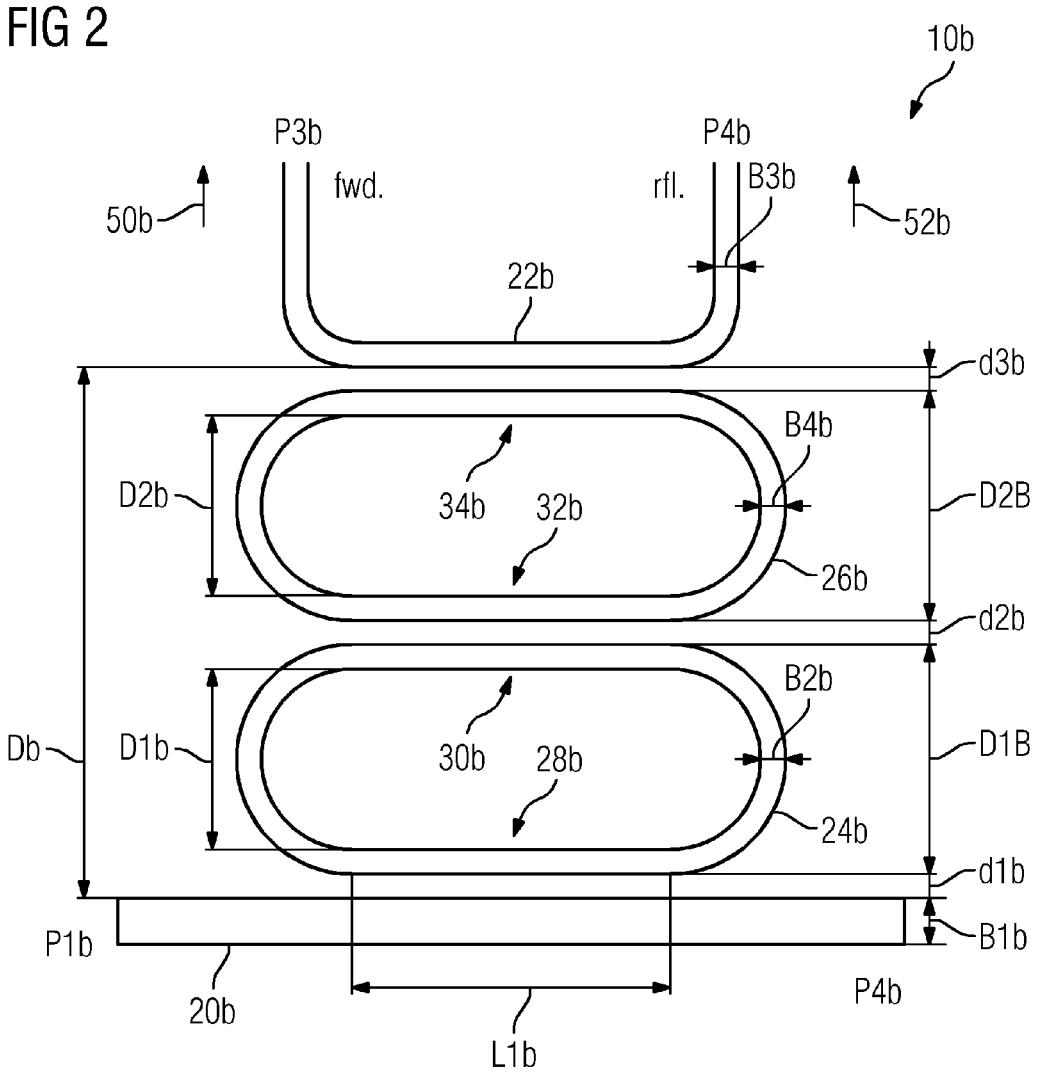
FIG. 2 shows one embodiment of a directional coupler having two coupling loops and without overlap.

FIG. 2 shows one embodiment of a directional coupler 10*b* having two coupling loops 24*b* and 26*b*. The directional coupler 10*b* is constructed like the directional coupler 10*a* apart from the inserted second coupling loop 26*b*, and so mutually corresponding elements and dimensions are designated by the lower-case letter b instead of the lower-case letter a.

The directional coupler 10*b* thus includes a power line 20*b* and a coupling line 22*b* arranged parallel to the power line 20*b*. The coupling line 22*b* is also designated as sense line or measuring line. The directional coupler 10*b* also includes the first coupling loop 24*b*, which is arranged between the power line 20*b* and the second coupling loop 26*b*, and the second coupling loop 26*b*, which is arranged between the first coupling loop 24*b* and the coupling line 22*b*.

In the example in FIG. 2, the power line 20*b* is straight and has edges lying parallel to one another. The coupling line 22*b* has a straight coupling section having edges lying parallel to one another. After the coupling section, the coupling line 22*b* at both ends is angled away from the second coupling loop 26*b* (e.g., with round sections). Alternatively, the coupling line 22*b* may likewise be straight in accordance with the course of the power line 20*b* (e.g., also see FIG. 3).

In the example, the coupling line 22*b* having a width B3b is narrower than the power line 20*b* having a width B1b (e.g., by more than 50 percent relative to the width B1b). However, the coupling line 22*b* and the power line 20*b* may also be of the same width. The coupling line 22*b* may also be wider than the power line 20*b*.

In the example, the coupling loop 24*b* has the same width B2b as the width B3b of the coupling line 22*b*. However, the coupling line 22*b* may also be wider or narrower than the coupling loop 24*b*.

In the example, the second coupling loop 26*b* has the same width B4b as the width B3b of the coupling line 22*b*. However, the coupling line 22*b* may also be wider or narrower than the second coupling loop 26*b*. In the example, both coupling loops 24*b* and 26*b* have the same shape and the same width B2b and B4b. However, the shape and/or the width B2b and B4b of the coupling loops 24*b* and 26*b* may also differ from one another.

The power line 20*b*, the coupling line 22*b* and the coupling loops 24*b* and 26*b* are, for example, composed of an electrically conductive material (e.g., copper) and are arranged on a substrate (e.g., see FIGS. 5 to 8). The substrate is, for example, a printed circuit board material, a ceramic substrate or a specific radio-frequency substrate.

The height of the power line 20*b*, of the coupling line 22*b*, and of the coupling loops 24*b* and 26*b* is determined according to the known design criteria for striplines. The height may, for example, be identical for all four elements 20*b*, 22*b*, 24*b* and 26*b*.

The coupling loop 24*b* is embodied in a ring-shaped fashion and has, at two sides situated opposite one another, a straight partial region 28*b* having edges parallel to one another and a straight partial region 30*b* having edges parallel to one another. The partial region 28*b* lies parallel to and in the vicinity of the power line 20*b*. The partial region 30*b* lies parallel to and in the vicinity of the coupling loop 26*b*.

The partial region 28*b* and the partial region 30*b* are electrically conductively connected to one another at respective left ends by, for example, a circle-arc-shaped or arcuate section of the coupling loop 24*b*. The partial region 28*b* and the partial region 30*b* are electrically conductively connected to one another at respective right ends by, for example, a further circle-arc-shaped or arcuate section of the coupling loop 24*b*.

The coupling loop 26*b* is likewise embodied in a ring-shaped fashion and has, at two sides situated opposite one another, a straight partial region 32*b* having edges parallel to one another and a straight partial region 34*b* having edges parallel to one another. The partial region 32*b* lies parallel to and in the vicinity of the partial region 30*b*. The partial region 34*b* lies parallel to and in the vicinity of the coupling line 22*b*.

The partial region 32*b* and the partial region 34*b* are electrically conductively connected to one another at respective left ends by, for example, a circle-arc-shaped or arcuate section of the coupling loop 26*b*. The partial region 32*b* and the partial region 34*b* are electrically conductively connected to one another at respective right ends by, for example, a further circle-arc-shaped or arcuate section of the coupling loop 26*b*.

The directional coupler 10*b* accordingly includes a port P1b or terminal (e.g., used as input), a port P2b (e.g., used as output), a port P3b (e.g., used for coupling out the forward (fwd.) transmitted waves; see arrow 50*b*), and a port P4b (e.g., used for coupling out the reflected (rfl.) waves (i.e., the backward transmitted waves or power; see arrow 52*b*).

Given suitable termination with, for example, a termination resistor, the port P3b and/or the port P4b may also remain in a state of not being connected. When the directional coupler 10*b* is used, the reflected power may be tapped off at the port P4b and thus detected or measured. This is utilized in a magnetic resonance tomograph, for example, where the power line 20*b* is coupled on the input side to an amplifier and on the output side to a coil for generating a magnetic field.

The ports P1b to P4b may also be designated as terminals and may be operated relative to a ground line (not illustrated).

The directional coupler 10*b* is configured in accordance with Maxwell's equations applicable to the transmission of electromagnetic waves, and so the exact dimensions are dependent on a design wavelength. The dimensions illustrated in FIG. 2 are not true to scale, but rather serve for simple illustration.

The directional coupler 10*b* includes, for example, the following geometrical design variables: a distance Db between mutually facing edges of the power line 20*b* and of the coupling line 22*b*; a distance D1b between mutually facing edges of the partial regions 28*b* and 30*b*; a distance D1B between edges of the partial regions 28*b* and 30*b* facing away from one another; a distance D2b between mutually facing edges of the partial regions 32*b* and 34*b*; a distance D2B between edges of the partial regions 32*b* and 34*b* facing away from one another; a distance d1b between the edge of the power line 20*b* that faces the coupling loop 24*b* or the partial region 28*b* and the edge of the partial region 28*b* that faces the power line 20*b*; a distance d2b between mutually facing edges of the partial regions 30*b* and 32*b*; a distance d3b between that edge of the partial region 34*b* that faces the coupling line 22*b* and the edge of the coupling line 22*b* that faces the coupling loop 26*b* or the partial region 34*b*; a width B1b of the power line 20*b*; a width B2b of the coupling loop 24*b*; a width B3b of the coupling line 22*b*; a width B4b of the coupling loop 26*b*; and a length L1b of the power line 20*b* in the coupling region that ends, for example, when the curvature of the coupling loop 24*b* begins.

Other or additional design variables may also be defined (e.g., distances relative to center lines). Values for the design variables mentioned are defined, for example, with the aid of the criteria mentioned in the introduction (e.g., based on a high value for the coupling attenuation and a high value for the directivity factor). A simulation program for the simulation of radio-frequency circuits may also be used during the design.

In this regard, the length L1b in the example is considerably less than one quarter of the design wavelength and is, for example, less than 5 percent or less than 1 percent of one quarter of the design wavelength. The length L1b also corresponds to the length of the partial region 28*b*, to the length of the partial region 30*b*, to the length of the partial region 32*b*, to the length of the partial region 34*b* and to the length of the coupling section of the coupling line 22*b*.

The length of the coupling loop 24*b* and/or of the coupling loop 26*b* is, for example, less than 5 percent or less than 1 percent of the design wavelength (e.g., measured at the outer circumferential edge or at a center line of the coupling loop 24*b* and/or 26*b*). The distance D1B and/or D2B is, for example, less than the length L1b (e.g., less than 80 percent of the length L1b).

The width B1b is, for example, less than 20 percent or less than 10 percent of the length L1b. The distances d1b, d2b and d3a are, for example, less than 20 percent or less than 10 percent of the width B1b.

The distance Db results, for example, from the sum of the distances d1b, D1B, d2b, D2B and d3b.

In the case of the directional coupler 10*b*, shielding surfaces corresponding to the shielding surfaces 54 and 56 (see FIG. 1) may be used, where, for example, the shielding surface corresponding to the shielding surface 54 may also extend over the coupling line 22*b* and the part of the coupling loop 26*b* that is adjacent to the coupling line 22*b*.

In other exemplary embodiments, more than two conductor loops are used. Instead of the coupling loops 24*b*, 26*b*, coupling frames may also be used (e.g., see the coupling frame illustrated in FIG. 3).

The coupling loops 24*b*, 26*b* may be arranged, as illustrated in FIG. 2, without overlap with respect to one another and with respect to the power line 20*b* and/or with respect to the coupling line 22*b*. Alternatively, at least one overlap is used or two or three overlaps are used, corresponding, for example, to the overlaps illustrated in FIGS. 6 to 8. In the case of three overlaps, the coupling line 22*b* is situated, for example, in a different conductive track plane than the power line 20*b*.

The shields corresponding to the shields or shielding surfaces 54 and 56 are optional and may be replaced or supplemented, for example, by shields in other conductive track planes.

Instead of the coupling loop 24*b* and/or the coupling loop 26*b*, in each case, a conductor surface filled in over the whole area and having the same contour as the coupling loop 24*b* and/or the coupling loop 26*b* may, for example, by used. The conductor surface has the same technical effect as the coupling loop 24*b* and/or 26*b* with regard to the coupling on account of the skin effect or other effects. A shielding effect such as is achieved by the shield 150 additionally occurs (see FIG. 3).

FIG. 3 shows a directional coupler 10*c* having a coupling frame 24*c* that is arranged in a different conductive track plane than a power line 20*c* and a coupling line 22*c* (e.g., thereabove or therebelow).

The directional coupler 10*c* includes the power line 20*c*, and the coupling line 22*c* arranged parallel to the power line 20*c*. The coupling line is also designated as sense line or measuring line. The directional coupler 10*c* also includes the coupling frame 24*c*, which is arranged between the power line 20*c* and the coupling line 22*c* and overlaps the power line 20*c* and the coupling line 22*c*. The directional coupler 10*c* includes a balancing structure 164 that is arranged at a distance from the power line 20*c*.

The power line 20*c* in the example in FIG. 3 is straight and has edges lying parallel to one another. The coupling line 20*c* in the example in FIG. 3 is likewise straight and has edges lying parallel to one another. Alternatively, the coupling line 22*c* at both ends may be angled away from the coupling frame 24*c* (e.g., see sections 160 and 162).

In the example, the coupling line 22*c* having a width B3c is just as wide as the power line 20*c* having a width B1c. However, the coupling line 22*c* may also be narrower than the power line 20*c* (e.g., by more than 50 percent relative to the width B1c). The coupling line 22*c* may also be wider than the power line 20*c*.

In the example, the coupling frame 24*c* has a width B2c that is less than the width B3c of the coupling line 22*a* and/or the width B1c of the power line 20*c* (e.g., at least 20 percent less). However, the coupling frame 24*c* may also be wider than or of the same width as the coupling line 22*a* and/or the power line 20*c*.

The power line 20*c*, the coupling line 22*c* and the coupling frame 24*c* are, for example, composed of an electrically conductive material (e.g., copper) and are arranged on a substrate (e.g., see FIGS. 5 to 8). The substrate is, for example, a printed circuit board material, a ceramic substrate or a specific radio-frequency substrate.

The height of the power line 20*c*, of the coupling line 22*c* and of the coupling frame 24*c* is determined according to the known design criteria for striplines. The height may, for example, be the same for all three elements 20*c*, 22*c* and 24*c*. Alternatively, only a first height of elements 20*c*, 22*c* in the same conductive track plane is the same. A second height of the elements or of the element in a different conductive track plane may differ from the first height.

The coupling frame 24*c* is embodied in a frame-shaped fashion and has, at two sides situated opposite one another, a straight partial region 28*c* having edges parallel to one another and a straight partial region 30*c* having edges parallel to one another. The partial region 28*c* lies parallel to and in the vicinity of the power line 20*c*. The partial region 30*c* lies parallel to and in the vicinity of the coupling line 22*c*. The coupling frame 24*c* has, at the other sides situated opposite one another, a third straight partial region having edges parallel to one another and a fourth straight partial region having edges parallel to one another.

The partial region 28*c* and the partial region 30*c* are electrically conductively connected to one another at respective left ends by the third straight partial region. The partial region 28*c* and the partial region 30*c* are electrically conductively connected to one another at respective right ends by the fourth partial region. The partial regions 28*c*, 30*c* and also the third partial region and the fourth partial region form a frame having, for example, four right angles.

The directional coupler 10*c* accordingly includes a port P1c or terminal (e.g., used as input), a port P2c (e.g., used as output), a port P3c (e.g., used for coupling out the forward (fwd.) transmitted waves), and a port P4c (e.g., used for coupling out the reflected (rfl.) waves (i.e., the backward transmitted waves or power)).

Given suitable termination with, for example, a termination resistor, the port P3c and/or the port P4c may also remain in a state of not being connected. When the directional coupler 10*c* is used, the reflected power may be tapped off at the port P4c and thus detected or measured. This is utilized in a magnetic resonance tomograph, for example, where the power line 20*c* is coupled on the input side to an amplifier and on the output side to a coil for generating a magnetic field.

The ports P1c to P4c may also be designated as terminals and may be operated relative to a ground line (not illustrated).

The directional coupler 10*c* is configured in accordance with Maxwell's equations applicable to the transmission of electromagnetic waves, and so the exact dimensions are dependent on a design wavelength. The dimensions illustrated in FIG. 3 are not true to scale, but rather serve for simple illustration.

The directional coupler 10*c* includes, for example, the following geometrical design variables: a width B1c of the power line 20*c*; a width B2c of the coupling frame 24*c*; a width B3c of the coupling line 22*c*; and a length L1c of the power line 20*c* in the coupling region that begins and ends, for example, where the coupling frame 24*c* begins and ends.

Other or additional design variables may also be defined (e.g., distances relative to center lines or the variables shown in FIGS. 1 and 2). Values for the design variables mentioned are defined, for example, with the aid of the criteria mentioned in the introduction (e.g., based on a high value for the coupling attenuation and a high value for the directivity factor). A simulation program for the simulation of radio-frequency circuits may also be used during the design.

In this regard, the length L1c in the example is considerably less than one quarter of the design wavelength and is, for example, less than 5 percent or less than 1 percent of one quarter of the design wavelength. The length L1c also corresponds approximately to the length of the partial region 28*c*, to the length of the partial region 30*c*, and to the length of the coupling section of the coupling line 22*c*.

The length of the coupling frame 24*c* is, for example, less than 5 percent or less than 1 percent of the design wavelength (e.g., measured at the outer circumferential edge or at a center line of the coupling frame 24*c*). A distance corresponding to the distance D1A (see FIG. 1) is, for example, less than the length L1c (e.g., less than 80 percent of the length L1c). In an alternative exemplary embodiment, this distance may also be equal to or greater than the length L1c.

The width B1c is, for example, less than 20 percent or less than 10 percent of the length L1c. The overlaps at the partial regions 28*c* and 30*c* or at the coupling locations are explained in greater detail below with reference to FIG. 4.

A shield corresponding to the shielding surface 54 indicated in FIG. 1 may be arranged above the coupling line 22*c* and above the partial region 30*c* (e.g., in a further conductive track plane). Additionally or alternatively, a shield corresponding to the shield 56 may be used above the power line 20*c* and the partial region 28*c*. The shield corresponding to the shield 56 may be arranged at a greater distance above the power line 20*c* than the shield corresponding to the shield 54 is above the coupling line 22*c*.

The coupling frame 24*c* may be arranged, as illustrated in FIG. 3, with overlap with respect to the power line 20*c* and/or with respect to the coupling line 22*c*. Alternatively, only one overlap is used or no overlap is used, corresponding, for example, to FIG. 1. If only one overlap is used, the non-overlapping power line 20*c* or the non-overlapping coupling line 22*c* may also be arranged in the same conductive track plane as the coupling frame 24*c* or in a different conductive track plane. If no overlap is used, the coupling frame 24*c* may also be arranged in the same conductive track plane as the power line 20*c* and the coupling line 22*c* or in a different conductive track plane.

The directional coupler 10*c* may also include two or more than two coupling frames 24*c*. The coupling frames may be arranged with or without an overlap among one another and/or with respect to the power line 20*c* and/or with respect to the coupling line 22*c*. The coupling frames may be arranged in the same conductive track plane or in mutually different conductive track planes.

Instead of the coupling frame 24*c*, in all directional couplers explained with reference to FIG. 3, a conductive structure or coupling structure having a different form may also be used (e.g., a coupling loop; see FIGS. 1 and 2).

Inside the coupling frame 24*c* and/or outside the coupling frame 24*c*, a large-area shield may be arranged (e.g., see inner shield 150 having a rectangular area and/or outer shield 152, from which a rectangle is cut out). Both shields 150 and 152 are optional and may be replaced or supplemented, for example, by shields in other conductive track planes.

Instead of the coupling frame 24*c*, a conductor surface filled in over the whole area may also be used. The conductor surface has the same technical effect as the coupling frame 24*c* with regard to the coupling on account of the skin effect or other effects. A shielding effect such as is achieved by the shield 150 also occurs. The conductor surface filled in over the whole area has, for example, the same contour as the coupling frame 24*c*.

A sectional line 166 is relevant to the cross sections illustrated in FIGS. 5 to 8.

Figure 4:
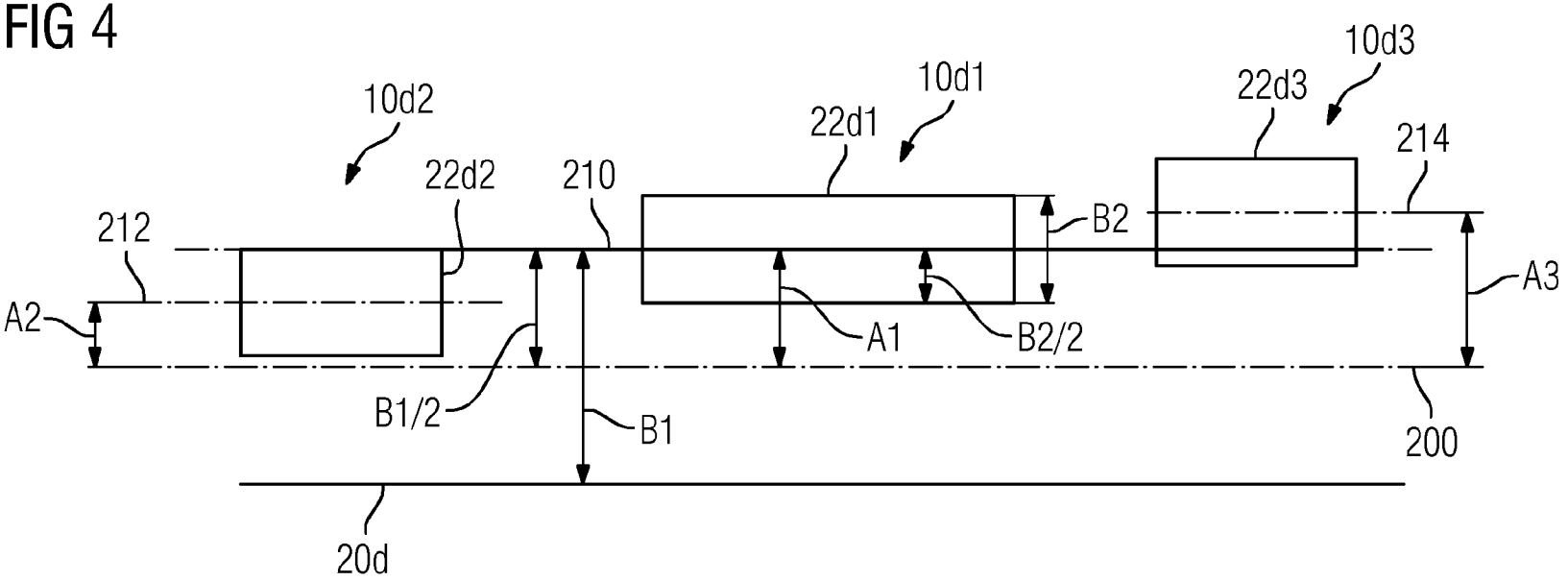
FIG. 4 shows different overlap levels in three directional coupler variants.

FIG. 4 shows different overlap levels in three directional coupler variants 10*d*1, 10*d*2, 10*d*3 that may occur in the directional couplers 10*a*, 10*b*, 10*c* or the directional couplers 10*e*, 10*f*, 10*g* and 10*h* explained below with reference to FIGS. 5 to 8 with the use of an overlap or overlaps.

In the case of a directional coupler 10*d*1, there is an overlap of half the area of a partial region of a coupling structure 22*d*1 (e.g., a coupling loop or a coupling frame) with a power line 20*d*, corresponding to one of the power lines 20*a*, 20*b*, 20*c*, 20*e*, 20*f*, 20*g* or 20*h*. A width B1 of the power line 20*d* is greater than a width B2 of the coupling structure 22*d*1 or of the partial region.

The power line 20*d* has a center line 200. The partial region of the coupling structure 22*d*1 has a center line 210 lying exactly on the edge of the power line 20*d*, thus resulting in a distance A1 between the center lines 200 and 210 that corresponds to half the width B1.

In the case of a directional coupler 10*d*2, there is an overlap of the whole area of a partial region of a coupling structure 22*d*2 (e.g., a coupling loop or a coupling frame) with the power line 20*d*, corresponding to one of the power lines 20*a*, 20*b*, 20*c*, 20*e*, 20*f*, 20*g* or 20*h*. A width B1 of the power line 20*d* is greater than a width B2 of the coupling structure 22*d*2 or of the partial region.

The power line 20*d* has the center line 200. The partial region of the coupling structure 22*d*2 has a center line 212. Between the center line 212 and the center line 200, there is a distance A2 corresponding to the difference between half of the width B1 and half of the width B2.

In the case of a directional coupler 10*d*3, there is an overlap of less than one quarter of the area of a coupling structure 22*d*3 (e.g., a coupling loop or a coupling frame) with the power line 20*d*, corresponding to one of the power lines 20*a*, 20*b*, 20*c*, 20*e*, 20*f*, 20*g* or 20*h*. A width B1 of the power line 20*d* is greater than a width B2 of the coupling structure 22*d*3.

The power line 20*d* has the center line 200. The partial region of the coupling structure 22*d*3 has a center line 214. Between the center line 214 and the center line 200, there is a distance A3 corresponding to approximately 80 percent or approximately 90 percent of the sum of half of the width B1 and half of the width B2.

The overlaps or overlap ranges lying between these overlaps, as shown in FIG. 4, may be provided for many directional couplers. The limit of the ranges shown may also be different (e.g., minus 30 percent to plus 30 percent relative to the distance A2 and/or to the distance A3). Similar ratios are also present for whole-area coupling structures, where, for example, instead of the width B2, reference may be made to a width in which 90 percent of the energy transport takes place, as mentioned above in association with the skin effect.

In FIG. 4, the lengths of the partial regions of the coupling structures 22*d*1, 22*d*2 and 22*d*3 are illustrated in a greatly shortened manner for reasons of better clarity and comparability of the three variants shown. The statements made above for the lengths L1a, L1b and L1c hold true for these lengths.

For example, the partial regions of the coupling structures 22*d*1, 22*d*2 and 22*d*3 correspond to the abovementioned partial regions 28*a*, 28*b*, 28*c*, 30*a*, 30*b*, 30*c* or 32*b* and 34*b* if an overlap is employed.

With regard to the partial regions 32*b* and 34*b*, the power line 20*d* may be replaced by the coupling line 22*b* and/or by the partial region 30*b*. Given identical widths of power line 20*d* and coupling structure 22*d*1, 22*d*2 and/or 22*d*3, likewise valid variants arise. The coupling structure 22*d*1 overlaps half again, the coupling structure 22*d*2 overlaps completely, and/or the coupling structure 22*d*3 overlaps again less than approximately one quarter.

Figure 5:
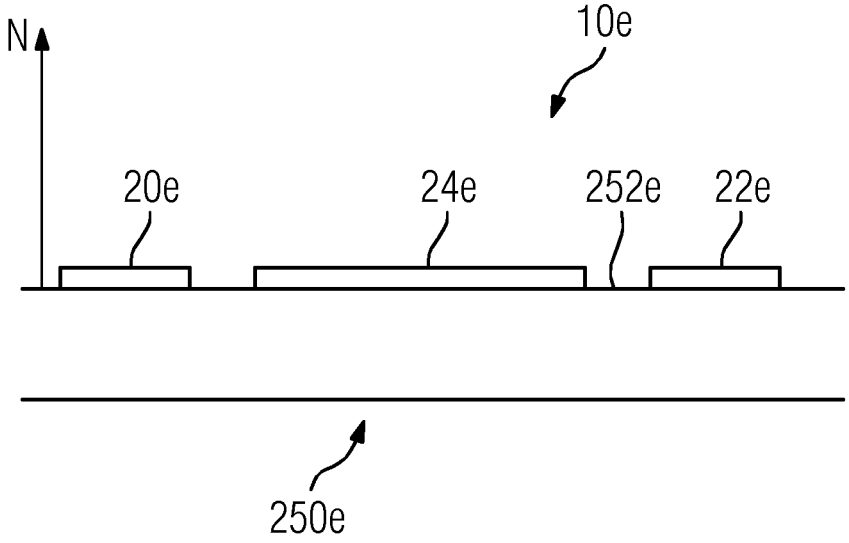
FIG. 5 shows one embodiment of a directional coupler having one conductive track plane.

FIG. 5 shows one embodiment of a directional coupler 10*e* having a conductive track plane 252*e* corresponding to the substrate surface of a substrate 250*e*. The conductive track plane may also be arranged in the substrate 250*e*. The substrate surface 252*e* has a normal direction N. The illustration in FIG. 5 corresponds, for example, to a cross section along the sectional line 60 shown in FIG. 1. Shielding structures are not illustrated. For example, the directional coupler 10*a* may be equipped with the substrate 250*e*.

In the conductive track plane 252*e*, the following elements are arranged in the following order from left to right: a power line 20*e* (e.g., see power line 20*a*; a coupling structure 24*e* (e.g., a coupling loop or a coupling frame; see coupling loop 24*a*); and a coupling line 22*e* (e.g., see the coupling line 22*a*).

Between the power line 20*e* and the coupling structure 24*e*, there is a lateral distance (e.g., in a direction tangential to the substrate surface of the substrate 250*e*; at a right angle with respect to the normal direction N). There is a further distance between the coupling structure 24*e* and the coupling line 22*e*.

Figure 6:
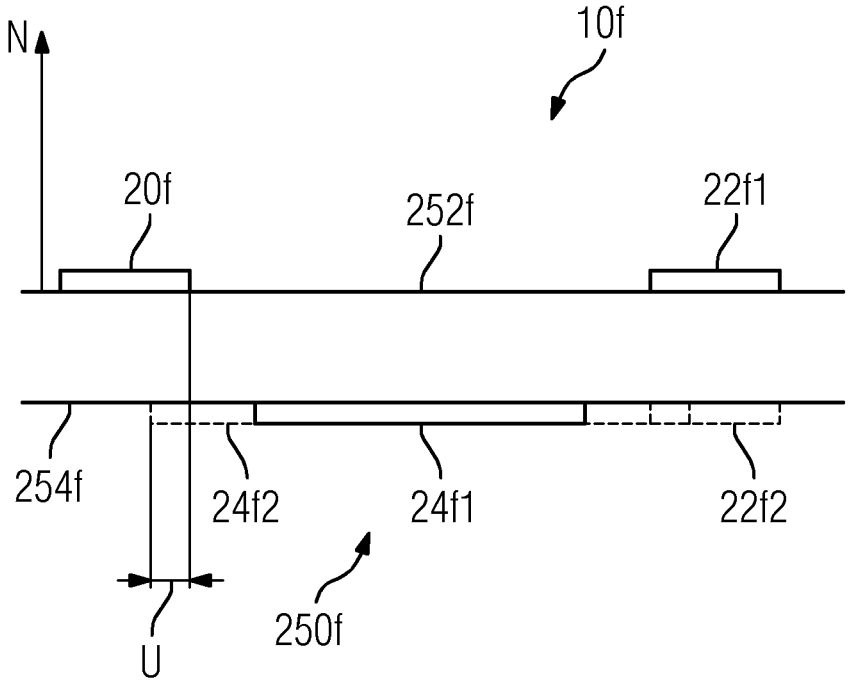
FIG. 6 shows one embodiment of a directional coupler having two conductive track planes.

FIG. 6 shows one embodiment of a directional coupler having two conductive track planes 252*f* and 254*f* corresponding to the substrate surfaces of a substrate 250*f*. One conductive track plane or both conductive track planes may also be arranged in the substrate 250*f*. The substrate surface 252*f* has a normal direction N. The illustration in FIG. 5 corresponds, for example, to a cross section along the sectional line 166 shown in FIG. 3. Shielding structures are not illustrated. Consequently, for example, the directional coupler 10*c* may be equipped with the substrate 250*f*.

A power line 20*f* (e.g., see power lines 20*a* to 20*d*) is arranged on the left in the conductive track plane 252*f*. A coupling line 22*f*1 (e.g., see coupling line 22*c*) is arranged on the right in the conductive track plane 252*f*. A coupling structure 24*f*1 is arranged in the conductive track plane 254*f* such that a corresponding projection along the normal direction N lies at a distance from the power line 20*f* and the coupling line 22*f*1. The coupling structure 24*f*1 corresponds, for example, to the coupling structure 24*c*.

Between the power line 20*f* and the coupling structure 24*f*1, there is a lateral distance. There is a further lateral distance between the coupling structure 24*f* and the coupling line 22*f*1.

In one variant, instead of the coupling structure 24*f*1, a coupling structure 24*f*2 is used. The coupling structure 24*f*2 is arranged with an overlap U with respect to the power line 20*f* and with a corresponding overlap also with respect to the coupling line 22*f*1. With regard to the size of the overlap U, reference is made to the explanations concerning FIG. 4. The overlap U may also occur only at one side of the coupling structure 24*f*2.

In a further variant, the coupling line 22*f*1 is not arranged in the conductive track plane 252*f* but likewise in the conductive track plane 254*f* (see coupling line 22*f*2). The coupling line 22*f*2 is situated at a location that remains the same with regard to the same reference system in both conductive track planes 252*f* and 254*f*. Thus, there is a lateral distance between the coupling structure 24*f*1 and the coupling line 22*f*2. In this variant, the coupling structure 24*f*1 may or may not overlap the power line 20*f* (see overlap U).

Figure 7:
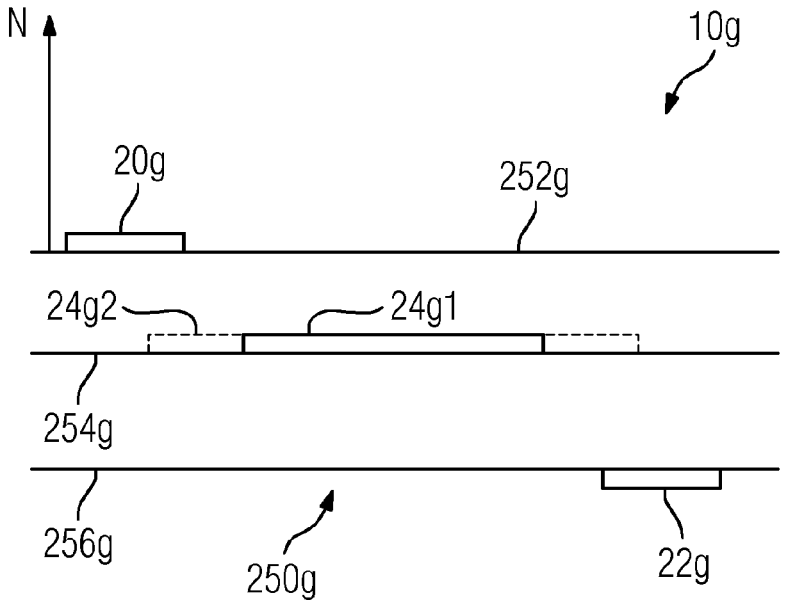
FIG. 7 shows one embodiment of a directional coupler having three conductive track planes.

FIG. 7 shows a directional coupler 10*g* having three conductive track planes 252*g*, 254*g* and 256*g* adjacent to one another. The conductive track planes 252*g* and 256*g* are, for example, the substrate surfaces of a substrate 250*g*. A normal direction N of the substrate surface 252*g* is depicted in FIG. 7. Alternatively, three conductive track planes 252*g*, 254*g* and 256*g* or at least two of the conductive track planes may be formed within a multilayer substrate.

From top to bottom, the following construction results: a power line 20*g* is situated on the left in the conductive track plane 252*g*; a coupling structure 24*g*1 or 24*g*2 (e.g., a coupling loop or a coupling frame) is situated in the center in the conductive track plane 254*g*; and a coupling line 22*g* is situated on the right in the conductive track plane 256*g*.

The coupling structure 24*g*1 does not overlap the power line 20*g* or the coupling line 22*g*, as seen in the normal direction N. Consequently, there is a lateral distance and a distance in the normal direction. By contrast, the coupling structure 24*g*2 overlaps the power line 20*g* and the coupling line 22*g*. The distance is in the normal direction N. An overlap of the coupling structure on one side, with the coupling structure overlapping only the power line 20*g* or only the coupling line 22*g*, may also be provided. With regard to the size of the overlap or overlaps, reference is made to the explanations concerning FIG. 4.

Figure 8:
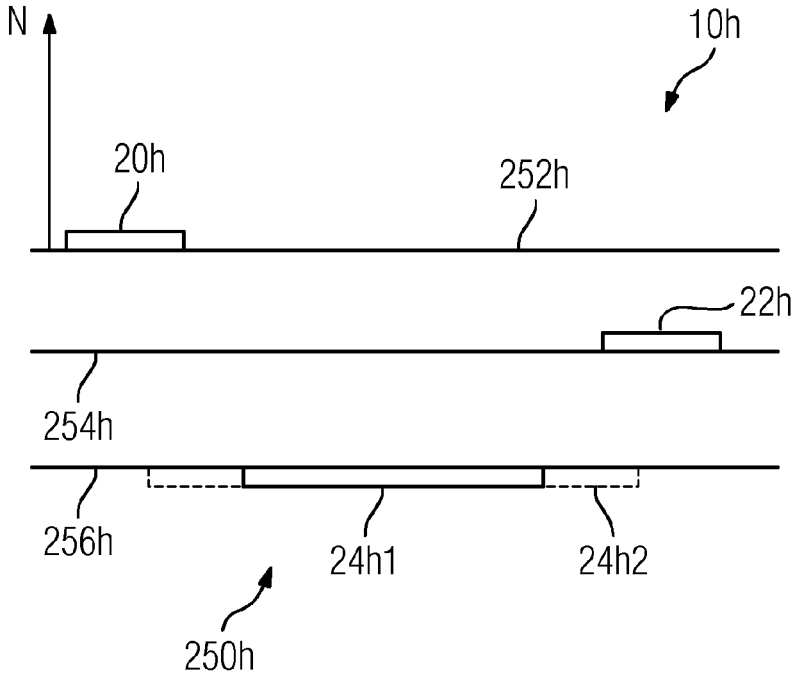
FIG. 8 shows a further embodiment of a directional coupler having three conductive track planes.

FIG. 8 shows a further embodiment of a directional coupler 10*h* having three adjacent conductive track planes 252*h*, 254*h* and 256*h*. The conductive track planes 252*h* and 256*h* are, for example, the substrate surfaces of a substrate 250*h*. A normal direction N of the substrate surface 252*h* is depicted in FIG. 8. Alternatively, three conductive track planes 252*h*, 254*h* and 256*h* or at least two of the conductive track planes may be formed within a multilayer substrate.

From top to bottom the following construction results: a power line 20*h* is situated on the left in the conductive track plane 252*h*; a coupling line 22*h* is situated on the right in the conductive track plane 254*h*; and a coupling structure 24*h*1 or 24*h*2 (e.g., a coupling loop or a coupling frame) is situated in the conductive track plane 256*h* in the center of the excerpt from the directional coupler 10*h* shown in FIG. 8.

The coupling structure 24*h*1 does not overlap the power line 20*h* or the coupling line 22*h*, as seen in the normal direction N. Consequently, there is a lateral distance and a distance in the normal direction. By contrast, the coupling structure 24*h*2 overlaps the power line 20*h* and the coupling line 22*h*. For example, the distance is in the normal direction N. An overlap of the coupling structure on one side, with the coupling structure overlapping only the power line 20*h* or only the coupling line 22*h*, may also be provided. With regard to the size of the overlap or overlaps, reference is made to the explanations concerning FIG. 4.

Instead of the coupling structures 24*e*, 24*f*1, 24*f*2, 24*g*1, 24*g*2 and 24*h*1 and 24*h*2 (e.g., two or more coupling structures may be used; see FIG. 2), where, if there is an overlap of the coupling structures, the coupling structures may also be arranged in a plurality of conductive track planes, which has already been explained.

The substrates shown in FIGS. 5 to 8 may also be used in the directional couplers 10*a*, 10*b*, 10*c*, 10*d*1, 10*d*2 and 10*d*3. The directional couplers shown in FIGS. 5 to 8 may be shielded toward the outside in further conductive track planes (e.g., toward the top and bottom or else on all sides).

The exemplary embodiments are not true to scale and not restrictive. Modifications within the scope of the action of a person skilled in the art may be provided. Although the invention has been illustrated and described more specifically in detail by virtue of the exemplary embodiments, the invention is not restricted by the examples disclosed, and other variations may be derived therefrom by a person skilled in the art without departing from the scope of protection of the invention. The developments and configurations may be combined among one another. The exemplary embodiments mentioned in the description of the figures may likewise be combined among one another. Furthermore, the developments and configurations may be combined with the exemplary embodiments mentioned in the description of the figures.

The invention claimed is:

1. A directional coupler comprising:

a substrate; a first conductive track provided on the substrate, wherein the first conductive track comprises a first port for forward transmitted waves and a second port for reflected transmitted waves;

a second conductive track provided on the substrate, wherein the second conductive track comprises a third port for input and a fourth port for output;

a conductive structure provided on the substrate and configured as a coupling loop or coupling frame operable to couple the first conductive track with the second conductive track, the conductive structure comprising:

a first partial region that is arranged nearer to the first conductive track than the first conductive track is to the second conductive track;

a second partial region that is arranged nearer to the second conductive track than the first conductive track is to the second conductive track; and wherein the conductive structure is arranged on a different plane of the substrate than the first conductive track and the second conductive track.

2. The directional coupler of claim 1, wherein the second conductive track is the same width as the first conductive track.

3. The directional coupler of claim 1, wherein the second conductive track is narrower than the first conductive track.

4. The directional coupler of claim 1, wherein the second conductive track is wider than the first conductive track.

5. The directional coupler of claim 1, wherein the first conductive track is arranged in a different plane of the substrate than the second conductive track and the conductive structure.

6. The directional coupler of claim 1, wherein the first conductive track, the second conductive track, and the conductive structure are arranged in three planes of the substrate, respectively.

7. The directional coupler of claim 4, wherein the first conductive track, the second conductive track, and the conductive structure are arranged in three planes of the substrate, respectively.

8. The directional coupler of claim 3, wherein the conductive structure overlaps the first conductive track in the first partial region.

9. The directional coupler of claims 7, wherein the conductive structure overlaps the first conductive track in the first partial region, and wherein the conductive structure overlaps the second conductive track in the second partial region.

10. The directional coupler of claims 7, wherein the conductive structure overlaps the first conductive track in the first partial region, or wherein the conductive structure overlaps the second conductive track in the second partial region.

11. The directional coupler of claim 7, wherein the first conductive track is straight at least in a region of the directional coupler and has a first width, wherein the conductive structure in the first partial region is straight and has a second width, and wherein for a first distance between a center line of the first partial region and a center line of the first conductive track, the first distance is at least a difference between half of the first width and half of the second width and at most 90 percent of a sum of half of the first width and half of the second width.

12. The directional coupler of claim 11, wherein the first partial region is arranged substantially parallel to the first conductive track.

13. The directional coupler of claim 11, wherein the second conductive track is straight at least in the region of the directional coupler and has a third width, wherein the conductive structure in the second partial region is straight and has a fourth width, and wherein for a second distance between a center line of the second partial region and a center line of the second conductive track, the second distance is at least a difference between half of the third width and half of the fourth width and at most 90 percent of a sum of half of the third width and half of the fourth width.

14. The directional coupler of claim 13, wherein the second partial region is arranged substantially parallel to the second conductive track.

15. The directional coupler of claim 7, wherein the second conductive track is straight at least in a region of the directional coupler and has a first width, wherein the conductive structure in the second partial region is straight and has a second width, and wherein for a first distance between a center line of the second partial region and a center line of the second conductive track, the first distance is at least a difference between half of the first width and half of the second width and at most 90 percent of a sum of half of the first width and half of the second width.

16. The directional coupler of claim 1, wherein the conductive structure has a circumferential edge or a center line having a length that is less than 20 percent of a wavelength of electromagnetic waves, the first conductive track being configured for transmission of the electromagnetic waves.

17. The directional coupler of claim 16, wherein the directional coupler is coupled by an input to a unit configured to output the electromagnetic waves having a design wavelength.

18. The directional coupler of claim 1, wherein the conductive structure is a first conductive structure, wherein the directional coupler further comprises a second conductive structure, wherein the second conductive structure comprises a first partial region that is arranged nearer to the first conductive structure than a second partial region of the second conductive structure, and wherein the second partial region of the second conductive structure is arranged nearer to the second conductive track than to the first conductive structure.

19. The directional coupler of claim 18, wherein the second conductive structure overlaps the first conductive structure in the first partial region of the second conductive structure, overlaps the second conductive track in the second partial region of the second conductive structure.

20. The directional coupler of claim 1, wherein the coupling loop or coupling frame encloses a non-conductive zone.

21. The directional coupler of claim 18, wherein the first conductive structure, the second conductive structure, or the first conductive structure and the second conductive structure are each configured as a coupling loop or a coupling frames that encloses a non-conductive zone.

22. The directional coupler of claim 1, wherein a length of the first conductive track is less than 5 percent or less than 1 percent of one quarter of a design wavelength.

23. The directional coupler of claim 1, wherein the directional coupler is used in a magnetic resonance tomograph or in a nuclear spin tomograph for determining a transmission power transmitted back from a coil via a transmission line.

24. A directional coupler comprising:

a first conductive track;

a second conductive track;

a conductive structure comprising:

a first partial region that is arranged nearer to the first conductive track than the first conductive track is to the second conductive track; and a second partial region that is arranged nearer to the second conductive track than the first conductive track is to the second conductive track, wherein the first conductive track, the second conductive track, and the conductive structure are arranged in three conductive track layers, wherein the conductive structure is arranged in a different conductive track layer than the first conductive track and the second conductive track, wherein the first conductive track is straight at least in a region of the directional coupler and has a first width, wherein the conductive structure in the first partial region is straight and has a second width, and wherein for a first distance between a center line of the first partial region and a center line of the first conductive track, the first distance is at least a difference between half of the first width and half of the second width and at most 90 percent of a sum of half of the first width and half of the second width.

25. A directional coupler comprising:

a first conductive track;

a second conductive track; and a conductive structure comprising:

a first partial region that is arranged nearer to the first conductive track than the first conductive track is to the second conductive track; and a second partial region that is arranged nearer to the second conductive track than the first conductive track is to the second conductive track, wherein the conductive structure has a circumferential edge or a center line having a length that is less than 20 percent of a wavelength of electromagnetic waves, the first conductive track being configured for transmission of the electromagnetic waves.

* * * * *